US005123785A

United States Patent [19]

Orfei

[11] Patent Number: 5,123,785

[45] Date of Patent: Jun. 23, 1992

[54] TRENCH-SHORING APPARTUS

[76] Inventor: Louis A. Orfei, 1211 Chicago Ave., Melrose Park, Ill. 60160

[21] Appl. No.: 604,108

[22] Filed: Oct. 29, 1990

[51] Int. Cl.[5] ..... E21D 5/12

[52] U.S. Cl. ..... 405/283; 405/272

[58] Field of Search ..... 405/272, 282, 283, 179; 37/142.5

[56] References Cited

U.S. PATENT DOCUMENTS

| | | | |
|---|---|---|---|
| 3,377,806 | 4/1968 | Morrice | 405/283 |
| 3,693,358 | 9/1972 | Morrice | 405/283 |
| 3,750,409 | 8/1973 | Orfei | 405/283 |
| 3,916,629 | 11/1975 | Thompson | 405/283 |
| 4,044,565 | 8/1977 | Stuckmann | 405/283 |
| 4,091,626 | 5/1978 | Thompson | 405/283 |
| 4,547,097 | 10/1985 | Bell | 405/283 |

FOREIGN PATENT DOCUMENTS

| | | | |
|---|---|---|---|
| 719699 | 12/1954 | United Kingdom | 405/282 |

*Primary Examiner*—Dennis L. Taylor
*Assistant Examiner*—Arlen L. Olsen

[57] ABSTRACT

A self-propelled trench-shoring apparatus having a modular panel construction whereby it may be readily adapted for use in lining trenches or open ground cuts of various depths and widths, including a integral back fill hopper for receiving and delivering bedding material into the open trench with the hopper removably supported on the rear end of the apparatus and capable of being varied in widths and depths to accommodate trenches of corresponding dimensions. The apparatus also including a tapered forwardly extending apron that allows the preceding digging machine to work more efficiently with respect to the shoring apparatus.

13 Claims, 6 Drawing Sheets

TRENCH-SHORING APPARTUS

SUMMARY OF THE INVENTION

This is an improvement in a self-propelled trench-shoring apparatus having the construction shown and described in my U.S. Pat. No. 3,750,409, dated Aug. 7, 1973. To the self-propelling modular panel construction of the patented trench-shoring apparatus there has been added a removable rear end hopper adapted to receive and deliver bedding material to the open trench as it progressively moves through the newly dug trench or ground cut. This hopper is so constructed that it may be varied in width and depth so as to correspond to the trenching or ground cut being developed by the apparatus.

The trench-shoring apparatus is also improved by having a removable forward apron adapted to be projected into the immediate area of ground removal while preventing the accidental spill or backfall into the trench before the side panels have been moved into shoring position.

BRIEF DESCRIPTION OF THE DRAWINS

Figure 1:
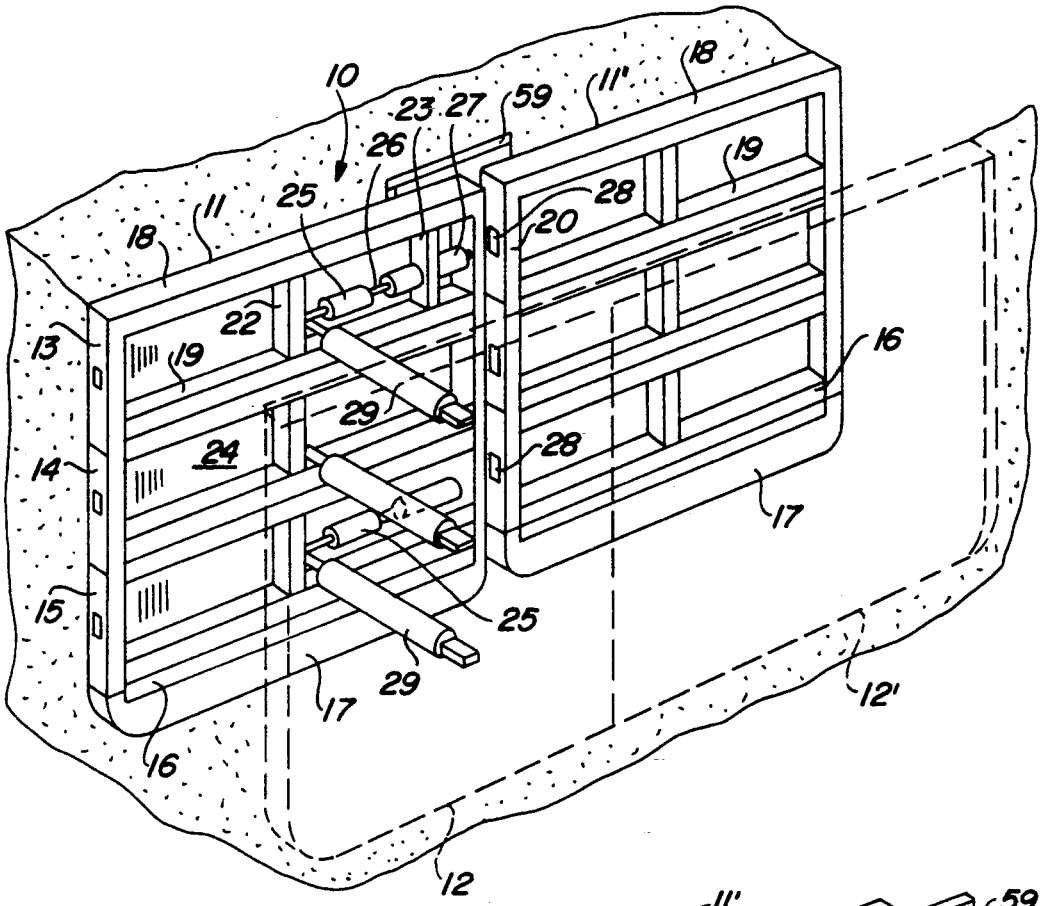
FIG.1 (PRIOR ART)
Figure 2:
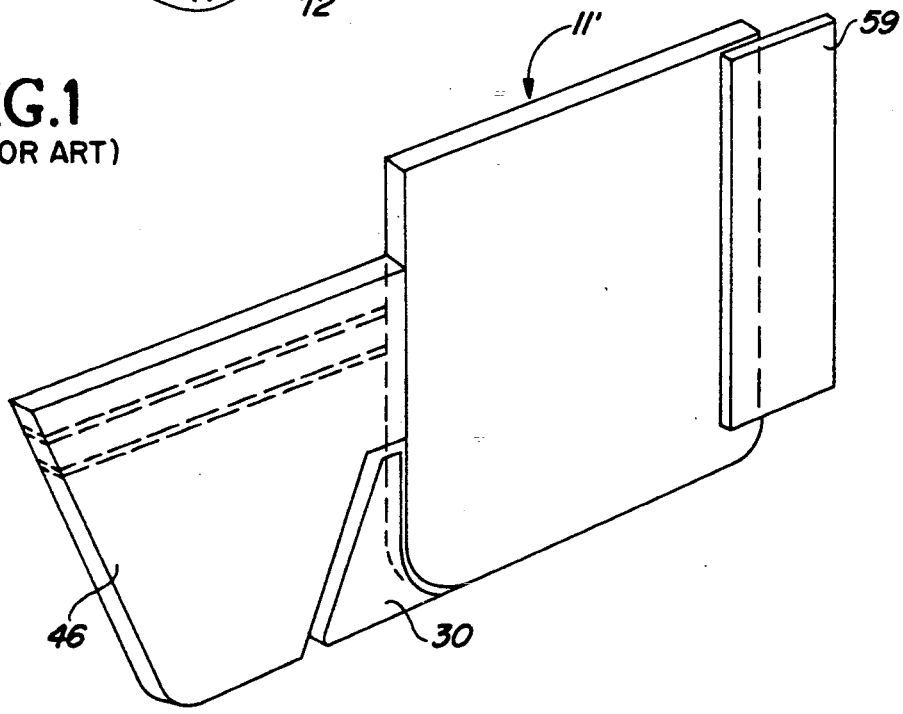
Figure 5:
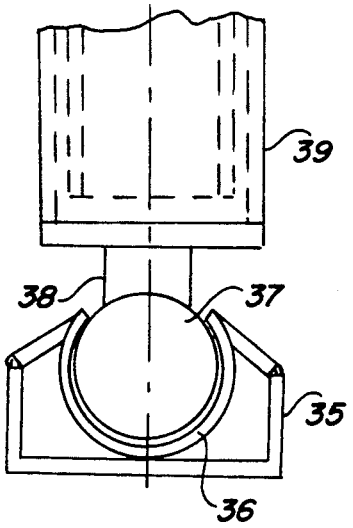
Figure 3:
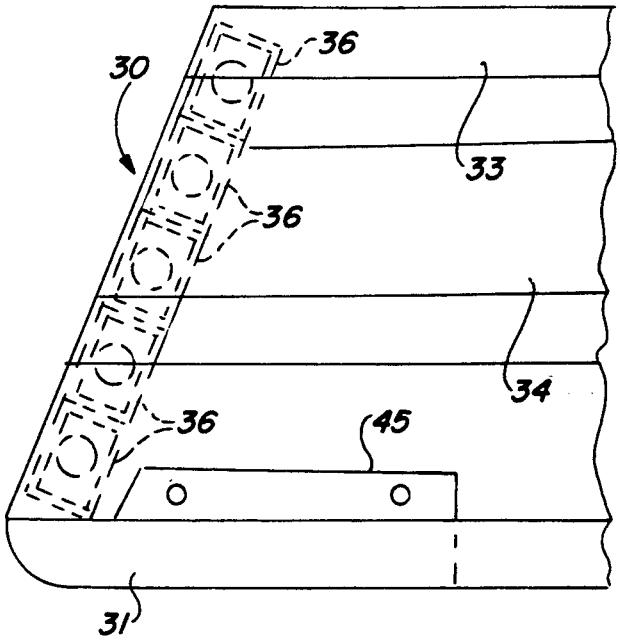
Figure 4:
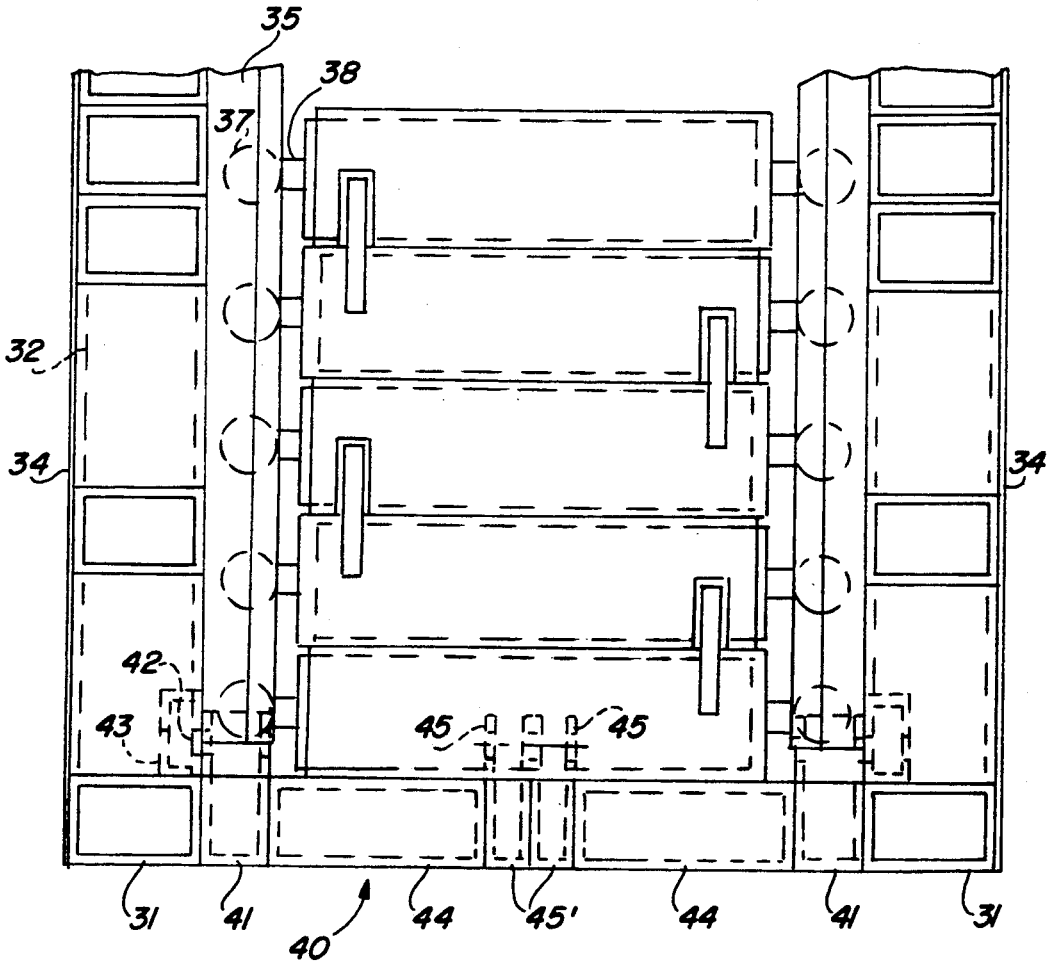
Figure 6:
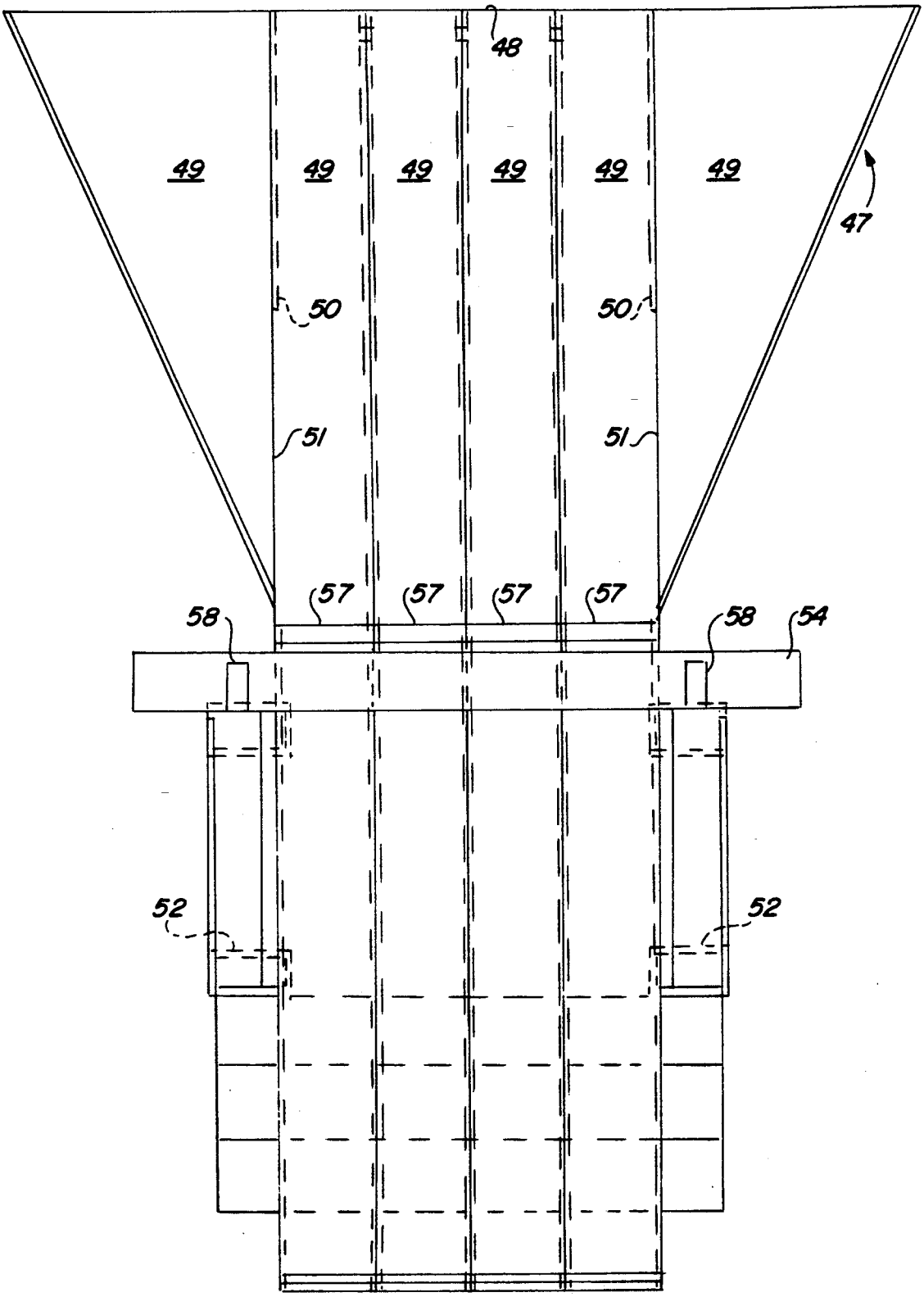
Figure 7:
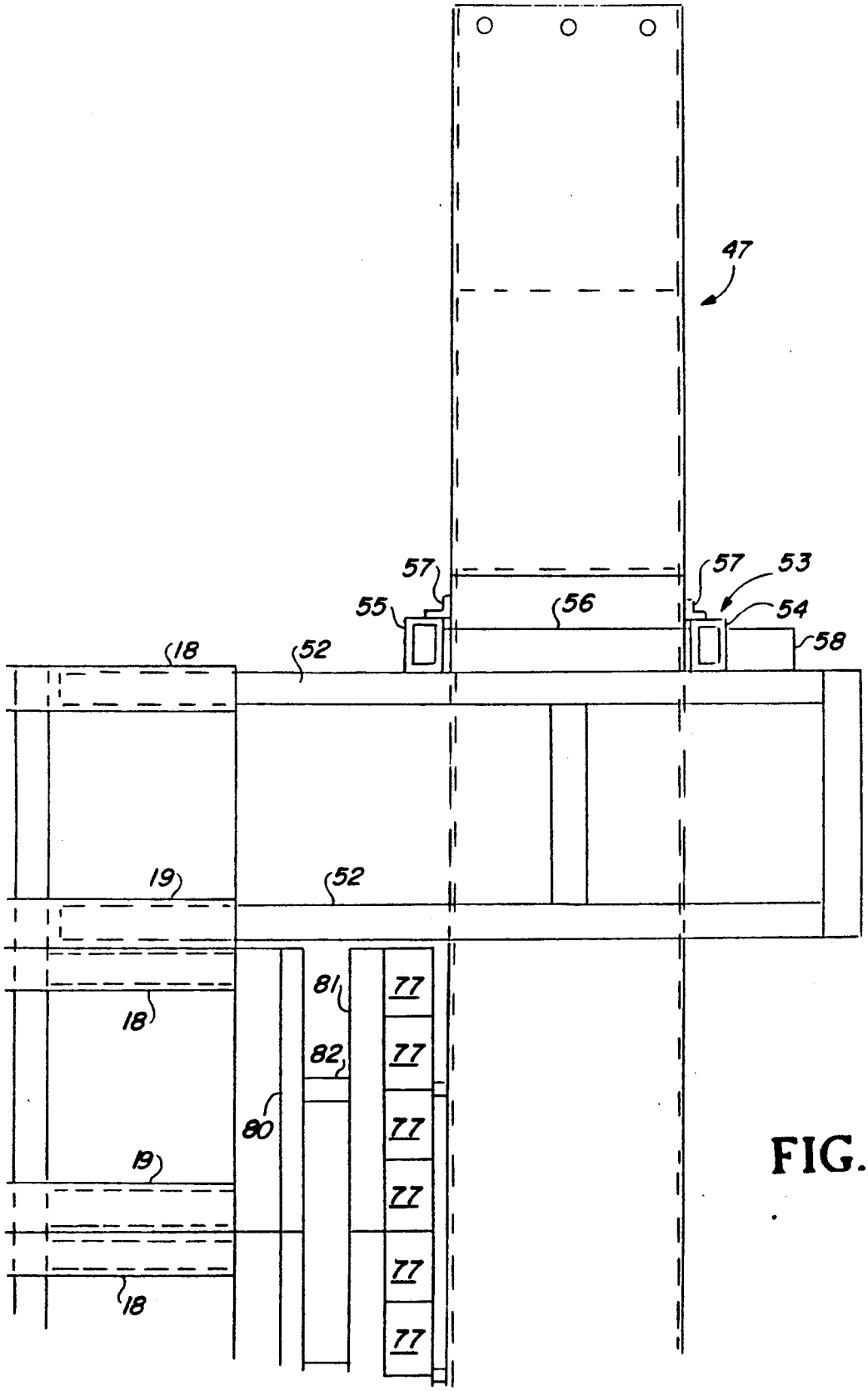
Figure 8:
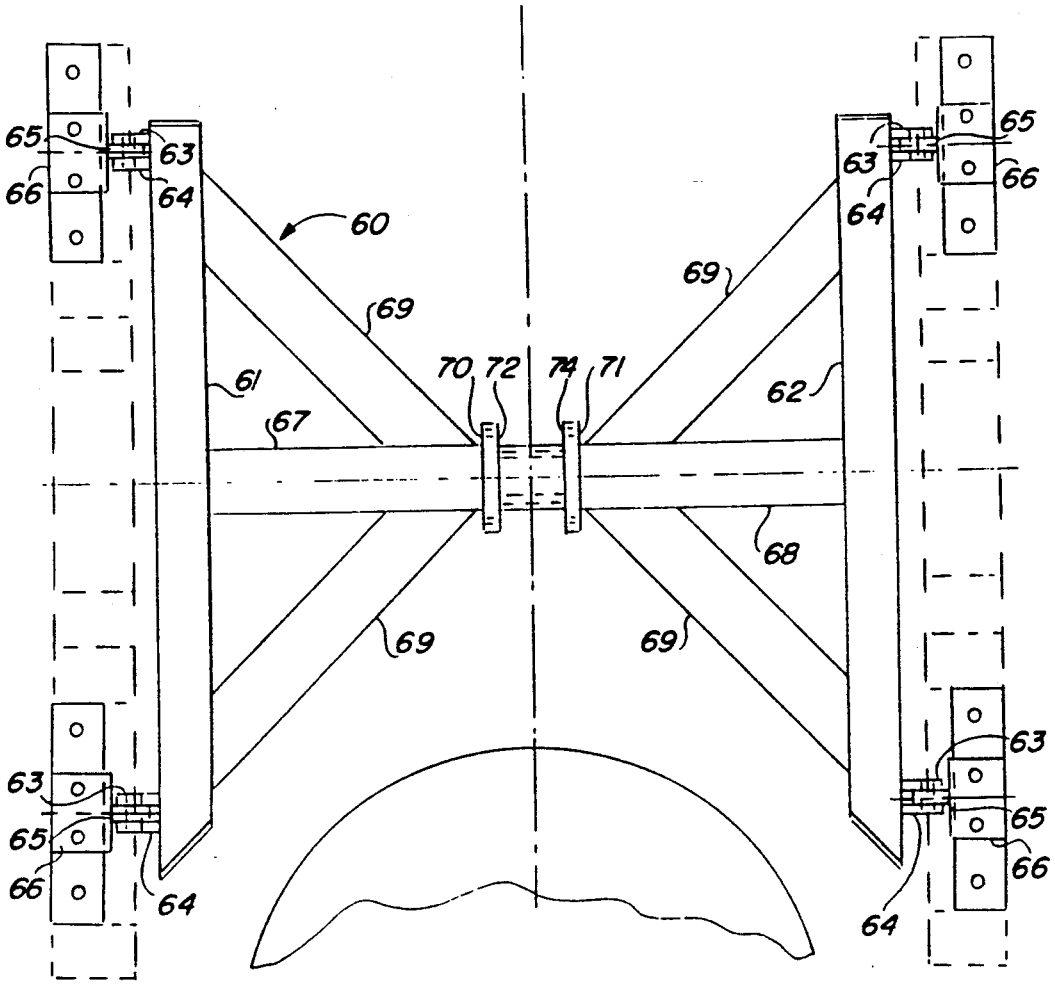
Figure 9:
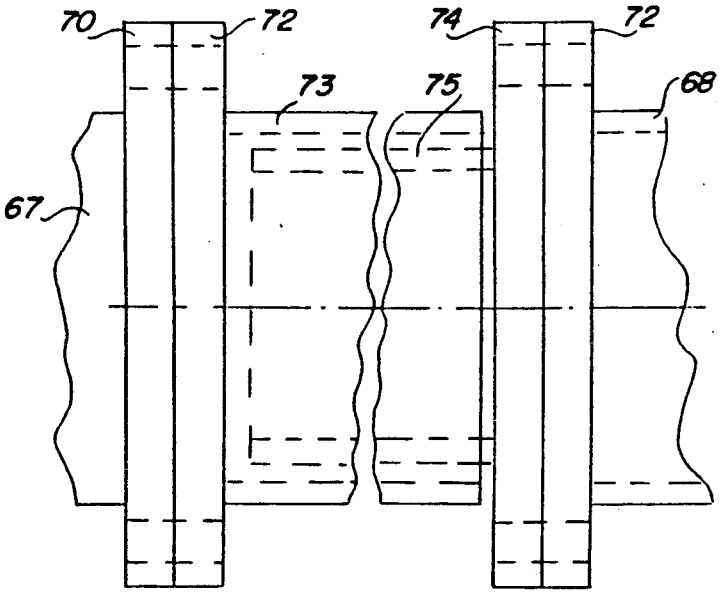
Figure 10:
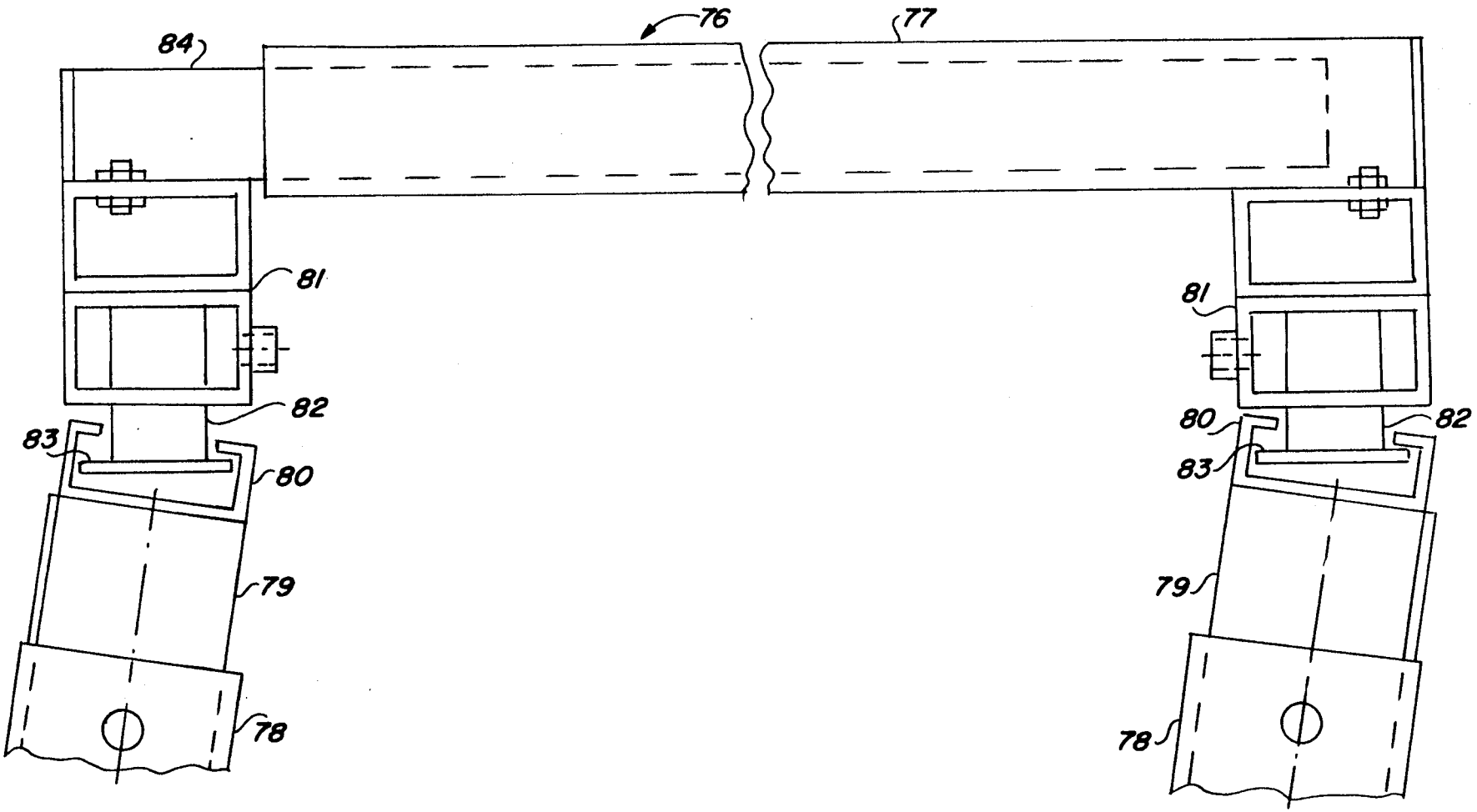

The improvement of this invention will be best understood by reference to the accompanying drawings in which the preferred construction and mode of operation is shown and wherein;

FIG. 1 is a fragmentary perspective view of the patented trench-shoring apparatus in operative position, FIG. 2 is a perspective view of a forward wall section adapted to be added to the apparatus of FIG. 1, FIG. 3 is a side elevational view of the forward apron for the trench-shoring apparatus, FIG. 4 is a front elevational view of the apron, FIG. 5 is a fragmentary detailed sectional view of the universal joint connection for the apron, FIG. 6 is a rear elevational view of the hopper for the trench-shoring apparatus, FIG. 7 is a fragmentary side elevational view of the hopper, FIG. 8 is a fragmentary front elevational view of a support strut for the apparatus, FIG. 9 is a partial view of the horizontal adjustable connection for the support strut of FIG. 8, and FIG. 10 is a fragmentary top plan view of the rear barrier connection to the ends of the side panels of the apparatus.

GENERAL DESCRIPTION

The principal object of the present invention is to provide improvements to a modular paneled shoring apparatus that is capable of being self-propelled by means of pressurized expanding and retracting structures which aperate both longitudinally and transversely along and against the sides of a trench continuously during the evacuation thereof.

As shown in FIG. 1 the apparatus 10 comprises a series of prefabricated retaining wall units 11 and 11', as well as corresponding wall units 12 and 12', shown in phanton. Each unit consists of a series of modular panels 13, 14, and 15, with each panel being identical in construction.

Each wall unit of the apparatus 10 includes base units 16 which provide skid-like frame members 17 carried by their lowermost panel 15.

The panels as shown in FIG. 1, are so constructed as to include a frame consisting of a pair of longitudinally extending tubular framing members 18 and 19, joined together at their corresponding opposite ends by vertical tubular end members 20 and 21. A center brace 22 is provided midway between the end members 20 and 21 as well as a guide member 23 which is positioned adjacent to but spaced from the end member 21. The tubular frame as described is then paneled on its exterior face with a suitable metal sheeting 24.

In FIG. 1 the trenching apparatus as shown in full lines consisting of units 11 and 11', with each unit connected together in such a a manner that one unit is movable longitudinally with respect to the other. In the arrangement shown the panels 13 and 15 of each unit are provided with hydraulic cylinders 25. One end of the cylinder is connected to the brace 22 of the panel. The free end of the piston 26 of the cylinder 25 is connected to an extension 27 which passes through suitable openings in the guide member 23 and the tubular end member 21. The free end of the extension 27 is pivotally connected to a bifurcated bracket 28 mounted on the external confronting face of the end member 20 of the juxtapositioned unit. The opposite wall unis 12 and 12' as shown in phantom are of the same constructin as just described.

The opposite wall units, such as 11, 12 and 11', 12'', of the apparatus are connected together by series of hydraulic cylinders 2-9, all of which are of the same construction and operate in the same manner with respect to corresponding pairs of apparatus. The hydraulic cylinders 29 have their bases conected to the center guide members 22 of each of the panels 13, 14 and 15 of the respected units 11, 11' and their piston ends connected to corresponding center guide members and respective panels of the wall units 12, and 12'.

When the apparatus has been assembled in accordance with the depth of the trench portion to be shored, the components will be arranged as partially shown in FIG. 1. It is to be understood that as the units 11 and 11' of the apparatus 10 as shown in FIG. 1 are connected to corresponding cooperating units 12 and 12', all such units are separated by the series of hydraulic cylinders 29 and moved horizontally relative to each other by the series of hydraulic cylinders 25.

To the patented construction as just described there is added the improvement of a forward projecting tapered apron 30 as viewed in FIGS. 2 and 3. The apron 30 consists of a bottom skid 31 and a vertically extending tubular support 32 which in turn supports a series of horizontally extending tubular frame members 33 of varying lengths. To the outer surfaces of the frame members 33 is an exterior metal sheeting 34. Connected to the inner surfaces of the member 33 and extending across their staggered ends, are confronting tracks 35 extending in a angled upward relation from the skid 31.

As shown in FIG. 5 each track 35 provides an open socket joint 36 which is adapted to freely receive a ball joint 37 carried by a telescopically extending stud 38 which in turn projects laterally out of the opposite ends of a apron wall section 39.

As there is an apron supporting side wall structure adapted to be removably connected to the front ends of each of the modular shoring panels 11' and 12', the apron wall sections 39 must be adapted to assume an angular relation between their opposite ends as each of the shoring panels 11' and 12' are moved in a stepped forward motion. Thus the ball joint and socket arrangement which in turn permits this movement.

Between the forward wall supporting sections of the apron 30 there is provided a interlock floor 40, as shown FIG. 4. This interlock floor 40 includes two assemblies, each comprising an elongated tubular base member 41. These base members 41 are bolted as at 42 to supporting tubular members 43 welded on to the forwardly projecting skids 31. The assemblies include bottom panels 44 that are placed between the skids 31 as shown in FIG. 4. At inner mating ends these panels 44 provide vertical flanges 45. To accommodate the varying widths of the wall units, tubular spacers 45', such as shown in FIG. 4, can be placed between the bottom panels 44. These spacers 45' include a vertical flange which match the vertical flanges 45 all of which provide aligned openings through which connecting bolts may be projected. If the panels 44 are bolted loosely together there will be allowed some slippage between the wall units as they are moved independently in a forward direction. If the panels 44 are bolted tighyly together no slippage will occur and wall units will be caused to move as a single structure.

By this arrangement as the shoring apparatus is projected forwardly into the ground cut the tapered forwardly proceeding apron 30 will prevent stray fill from falling in between the advancing wall units, while the interlocking floor 40 will stabilize the forward ends of the advancing walll units preventing them from toeing in or out.

When the trenching apparatus is used in sand, gravel or extremely soft clays, where the excavated trench wall has a tendency to cave in before the basic shoring units can be advanced, there is provided advanced poling plates 46. These plates 46 may be attached to the forward edges of the units 11' and 12' by means of tubular struts extending into any of the framing members 18 and 19 of such wall units.

These poling plates 46 allow the digging apparatus to take short cuts ahead of the apparatus allowing the plates 46 to be gradually moved therein thus affording more control in preventing a cave-in before the advancing wall units can be secured in place in the trench.

Referring to FIG. 6 there is illustrated a back fill hopper 47. The hopper includes a open funnel-like structure 48 which is constructed from a number of chutes 49 adapted to be bolted together in side by side relation. It should be known that the outer most chutes 49 provide a shortened exterior wall 50 thus providing a mouth 51 between them and the wing-like portions of the hopper 47.

As shown in FIG. 7 the hopper supporting structure comprises a pair of telescopic rectangular shaped frame members 52 adapted to be projected into the open ends of the wall panel members 18 and 19. Adapted to sit upon each of the frame members 52, in a horizontal plane, is a hopper support 53. This support 53 comprises two elongated tubular cross beams 54 and 55 connected intermediate their ends by cross braces 56.

Each of the chutes 49 have fixed on their front and rear walls stays 57 which are in the form of angle irons, which when the chutes are placed within the confines of the hopper support 53 will seat upon the cross beams 54 and 55 as shown in FIGS. 6 and 7. The entire assembly is held in position upon the support 53 by a pair of stops 58 mounted on the upper surface of theframe members 52.

As the chutes 49 are connected together by suitable connectors such as nuts and bolts (not shown), the width of the hopper 47 can be varied to accommodate the width of the trench being dug. The length of the chutes can in the same manner be extended to correspond to the depth of the trench.

As the apparatus is operated to move longitudinally through the trench the normal function of the parts causes a separation between the panels 11 and 11' and panels 12 and 12' as shown. To prevent debris from falling into the space during the operation a cover plate 59 (see FIGS. 1 and 2), may be mounted on the outside of one of the panels, such as panel 11' as shown, and be of such a width as to cover the opening when it occurs.

In the employment of the apparatus the depth of the trench walls increases according to the diameter of the utility pipes accommodated therein. As the diameter of the pipes get larger the height of the unsupported trench wall from the bottom of the shoring maching to the nearest supporting hydraulic cylinder 29 increases, therefore, at a given point above the trench floor, this distance gets to be to great to be left unsupported.

A pipe arch 60 as shown in FIG. 8 is provided to add additional support to resist the bottom of the opposing wall panels from toeing in and possible wedging against the pipe.

The pipe arch 60 consists of two upright beams 61 and 62 fabricated from rectangular tubing, with each of the beams providing on their outside wall surfaces a pair of clevis 63 and 64. Each of these clevis by a hinge pin (not shown) is connected to a eyelet 65 provided by a mounting bracket 66 fixedly connected to selected portions of the wall units 11 and 11'.

Extending perpendicularly from each beam 61 and 62 and in axial alignment are supporting struts 67 and 68. These struts 67 and 68 are supported by knee braces 69 as shown. Each of the struts 67 abd 68 terminate at their confronting ends in flanges 71 and 70. As shown in FIG. 9 the flange 70 may be connected to a corresponding connecting flange 72 of a sleeve 73. The flange 71 may be connected to a connecting flange 74 of a insert 75. By this arrangement braces 61 and 62 are assembled together for axial movement of the struts 67 and 68.

It is the accepted practice to position the pipe arch 60 on the same horizontal plane as the lower-most available cylinder 29. By its construction the pipe arch 60 may be variable in width as well as in height. Its width may be increased by extending the connection between the strut 67 and 68 by substituting longer spacers between the end flanges 70 and 71 of the struts 67 and 68.

A representative illustration of a back fill barrier 76 is shown in FIGS. 1 and 7. The purpose of the back fill barrier is to restrain back fill material from caving into the evacuated trench between the rear-most wall units 11 and 12 of the apparatus. It is also required that the barrier be so connected to the wall units that is can be raised or lowered independently of the wall units. This feature is to allow the apparatus to move forwardly in the trench with the back fill barrier 76 raised to accommodate the newly installed pipe or other structure.

The barrier 76 is made up of a series of panel sections 77 corresponding in size to the modular panels 13,14 and 15 of the wall units.

To mount the barrier 76 onto the apparatus, suitable extensions 78 are carried by the end members 20 of the panels 11 and 12. These extensions 78 house telescopic arms 79 which in turn support at their free ends elongated U-shaped tracks 80, (see FIG. 10).

At the ends of certain of the panel sections 77 of the barrier 76 are connectors 81 that carry laterally extending studs 82 which provide at their free ends a disc like member 83. These disc like members 83 are adapted to be slidably projected into the tracks 80 thus permitting the series of panel sections 77 of the barrier 76 to be raised or lowered relative to the wall units of the apparatus.

As shown in FIG. 10 each of the panel sections 77 of the barrier 76 includes telescopic strut members 84 whereby the barrier will accommodate trenching of various widths.

From the forgoing I have described the important improvements to my earlier patented trench shoring apparatus. These improvements do not effect the efficient operation of the previous apparatus but adds thereto such refinements that make it totally self contained trench-shoring and trench refilling maching capable of permitting safe efficient trench digging and equipment installation therein as required by the industry.

While I have illustrated and described the preferred form of construction for carrying by invention into effect, this is capable of variation and modification without departing from the spirit of the invention. I therefore, do not wish to be limited to the precise details of construction as set forth, but desire to avail myself of such variations and modification as come within the scope of the appended claims.

Having thus described my invention what I claim as new and novel and desire to project by Letters Patent is:

1. A self-propelled trench-shoring apparatus having confronting wall units with each wall unit being movably connected along a vertical edge so that when disposed in horizontal alignment in an open trench they form a shoring apparatus of varying lengths, means for movably connecting spaced apart parallelly extending wall units together for reciprocal movement transversely with respect to their longitudinal lengths and means for moving each wall unit horizontally through the open trench while being held in their spaced parallel relation wherein the improvement comprises;

a) a forwardly projecting apron mounted on the leading edge of the apparatus consisting of a pair of side supports mounted on the leading edge of each of the leading wall units, and a series of panel members extending between said side supports and mounted one upon another so as to extend in an upward, rearward angular relation from the forward direction of movement of the apparatus, b) means for mounting said apron to the forward edge of the confronting wall units so as to position said apron across the front of said apparatus to prevent debris from being dislodged from the trench walls into the area between the spaced apart parallelly extending wall units, and c) a hopper member carried by the trailing end of the apparatus and providing means for delivering bedding material to the open trench.

2. A self-propelled trench-shoring apparatus as defined by claim 1 including a plurality of independent chutes carried by said hopper member including means for removably connecting said chutes together so that the width of said hopper may be varied to accommodate the width of the trench being filled.

3. A self-propelled trench-shoring apparatus as defined by claim 2 including a support member for removably mounting said hopper and said chute members carried thereby upon the trailing edge of the confronting wall units of the apparatus.

4. A self-propelled trench-shoring apparatus as defined by claim 3 wherein said means for mounting each of said panel members to said side supports include a ball and socket arrangement provided at each end of each of said panel members for mounting onto a track provided by said side supports, whereby each panel member of said apron will have limited pivotal movement relative to said side supports through a horizontal plane.

5. A self-propelled trench-shoring apparatus as defined by claim 2 wherein said means for mounting each of said panel members to said side supports include a ball and socket arrangement provided at each end of each of said panel members for mounting onto a track provided by said side supports, whereby each panel member of said apron will have limited pivotal movement relative to said side supports through a horizontal plane.

6. A self-propelled trench-shoring apparatus as defined by claim 1 wherein said means for mounting each of said panel members to said side supports include a ball and socket arrangement provided at each end of each of said panel members for mounting onto a track provided by said side supports, whereby each panel member of said apron will have limited pivotal movement relative to said side supports through a horizontal plane.

7. A self-propelled trench-shoring apparatus as defined by claim 6 including an arch support extending between the confronting wall units for cooperating with the means for removably connecting said spaced apart parallelly extending wall units to resist conversion there between, said arch support including means for adjusting its width so as to correspond to the width between the wall units.

8. A self-propelled trench-shoring apparatus as defined by claim 6 including a shielding member carried on the exterior wall surfaces of certain of said wall units adjacent their vertical edge connection and being of a size to extend beyond so as to overlap the exterior wall surface of the adjacent wall unit to cover the open space there between when said certain of said wall units are moved away from said adjacent wall units so as to prevent debris from falling into said open space during movement of the apparatus through the trench.

9. A self-propelled trench-shoring apparatus as defined by claim 1 including an arch support extending between the confronting wall units for cooperating with the means for removably connecting said spaced apart parallelly extending wall units to resist conversion there between, said arch support including means for adjusting its width so as to correspond to the width between the wall units.

10. A self-propelled trench-shoring apparatus as defined by claim 9 wherein each wall unit of the apparatus is constructed from modular panel sections, and wherein the apparatus includes a back fill barrier positioned between the rear ends of the wall units and said hopper member, said back fill barrier being constructed from modular sections corresponding in size to said panel sections of the wall units, with said panel sections of said barrier and the panel sections of the wall units providing vertical telescopic connections there between whereby said barrier may have independent vertical movement relative to the apparatus.

11. A self-propelled trench-shoring apparatus as defined by claim 9 including a shielding member carried on the exterior wall surfaces of certain of said wall units adjacent their vertical edge connection and being of a size to extend beyond so as to overlap the exterior wall surface of the adjacent wall unit to cover the open space there between when said certain of said wall units are moved away from said adjacent wall units so as to prevent debris from falling into said open space during movement of the apparatus through the trench.

12. A self-propelled trench-shoring apparatus as defined by claim 1 wherein each wall unit of the apparatus is constructed from modular panel sections, and wherein the apparatus includes a back fill barrier positioned between the rear ends of the wall units and said hopper member, said back fill barrier being constructed from modular sections corresponding in size to said panel sections of the wall units, with said panel sections of said barrier and the panel sections of the wall units providing vertical telescopic connections there between whereby said barrier may have independent vertical movement relative to the apparatus.

13. A self-propelled trench-shoring apparatus as defined by claim 1 including a shielding member carried on the exterior wall surfaces of certain of said wall units adjacent their vertical edge connection and being of a size to extend beyond so as to overlap the exterior wall surface of the adjacent wall unit to cover the open space there between when said certain of said wall units are moved away from said adjacent wall units so as to prevent debris from falling into said open space during movement of the apparatus through the trench.

* * * * *